US006798328B2

(12) United States Patent
Uchiyama

(10) Patent No.: US 6,798,328 B2
(45) Date of Patent: Sep. 28, 2004

(54) COIL APPARATUS

(75) Inventor: Takahiro Uchiyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 48 days.

(21) Appl. No.: 10/298,336

(22) Filed: Nov. 15, 2002

(65) Prior Publication Data

US 2003/0112113 A1 Jun. 19, 2003

(30) Foreign Application Priority Data

Dec. 13, 2001 (JP) ..... 2001-380471

(51) Int. Cl.[7] ..... H01F 27/30
(52) U.S. Cl. ..... 336/208; 336/90; 336/198
(58) Field of Search ..... 336/208, 198, 336/90, 96, 229, 192

(56) References Cited

U.S. PATENT DOCUMENTS 4,234,865 A * 11/1980 Shigehara ..... 336/92
4,763,072 A * 8/1988 Katoh et al. ..... 324/253
5,814,986 A * 9/1998 Goskowicz et al. ... 324/207.26
6,538,546 B2 * 3/2003 Serino et al. ..... 336/96
6,590,487 B2 * 7/2003 Uchiyama ..... 336/90
6,616,249 B2 * 9/2003 Han ..... 303/119.3

FOREIGN PATENT DOCUMENTS

JP 2000-030961 1/2000

* cited by examiner

*Primary Examiner*—Anh Mai
(74) *Attorney, Agent, or Firm*—Gerald E. Hespos; Anthony J. Casella

(57) ABSTRACT

A coil apparatus includes a yoke (30) with an open containing chamber (31) that can accommodate a coil (10) formed by binding a wiring (12) around a bobbin (11). The containing chamber (31) is provided on an opening edge with bearings (34) that can receive a lid (40) behind the coil. The lid (40) is secured to the bearings (34) by welding after mounting the lid (40) on the bearings (34). The yoke (30) and lid (40) cover the coil (10.).

12 Claims, 13 Drawing Sheets

COIL APPARATUS

BACKGROUND OF THE INVENTION

1. Field of the Invention

This invention relates to a coil apparatus.

2. Description of the Related Art

Heretofore, a coil apparatus has been produced by binding a wiring around a bobbin to form a coil, transferring the coil to a client and then accommodating the coil in a yoke. A housing is molded around the coil by to prevent the winding from being broken during transport to the client and to enhance a high-impact property of the bobbin. An example of such a coil apparatus is disclosed in Japanese Patent Public Disclosure No. HEI 12-30961 (2000).

The molding method is carried out by setting the coil in a mold die and pouring a molten resin material into the mold die. The mold die, however, increases the cost of production.

In view of the above problem, an object of the present invention is to provide a coil apparatus that can protect a coil at a low cost.

SUMMARY OF THE INVENTION

The invention is directed to a coil apparatus comprising: a coil formed by binding a wiring around a bobbin; and a holding member having a substantially annular containing chamber adapted to accommodate the coil. The holding member includes a closing element for closing the containing chamber to cover the coil.

The closing element preferably includes a lid to be mounted on the containing chamber and secured to the holding member.

An elastic element may be disposed between the lid and the bobbin so that the elastic element is elastically compressed when the lid is mounted on the containing chamber.

A pair of seal rings may be disposed between opposed peripheral surfaces of the lid and containing chamber so that the containing chamber is sealed when the seal rings come into close contact with the opposed peripheral surfaces.

The closing element may include a potting material filled into and solidified in the containing chamber.

Anti-rotation means may be provided between the bobbin and the holding member to maintain the bobbin stationary relative to the holding member when the means are coupled to each other.

The containing chamber is closed by providing the closing element on the holding member to cover the coil after the coil has been accommodated in the containing chamber of the holding member. Thus, the coil is not exposed outwardly and is protected by the holding member and closing element.

The closing element closes the containing chamber. Thus, it is possible to protect the coil at a low cost in comparison with the prior art coil apparatus in which the housing is formed by molding with the mold die.

The lid is mounted on and secured to the holding member after the coil is accommodated in the containing chamber. Thus, the holding member and lid cover the coil.

The elastic member is compressed elastically between the lid body and the bobbin. Therefore, it is possible to hold the coil with no play between the coil and the holding member and between the coil and the lid.

A pair of seal rings seal the containing chamber. As a result, it is possible to prevent external liquid from entering the containing chamber.

The potting material is injected into the containing chamber after the coil has been accommodated in the containing chamber and the coil is fixed in the containing chamber when the potting material is solidified. Accordingly, it is possible to restrict a relative displacement in the peripheral direction between the bobbin and the holding member and to maintain them at an anti-rotation position.

The foregoing and other features of the present invention will become apparent to one skilled in the art to which the present invention relates upon consideration of the invention with reference to the accompanying drawings.

DETAILED DESCRIPTION OF THE PREFERRED EMBODIMENTS

A first embodiment of a coil apparatus in accordance with the present invention will be described below by referring to FIGS. 1 to 6. A coil apparatus in the first embodiment includes a coil 10, a yoke 30 for accommodating the coil 10, and a lid 40 to cover the coil 10.

Figure 1:
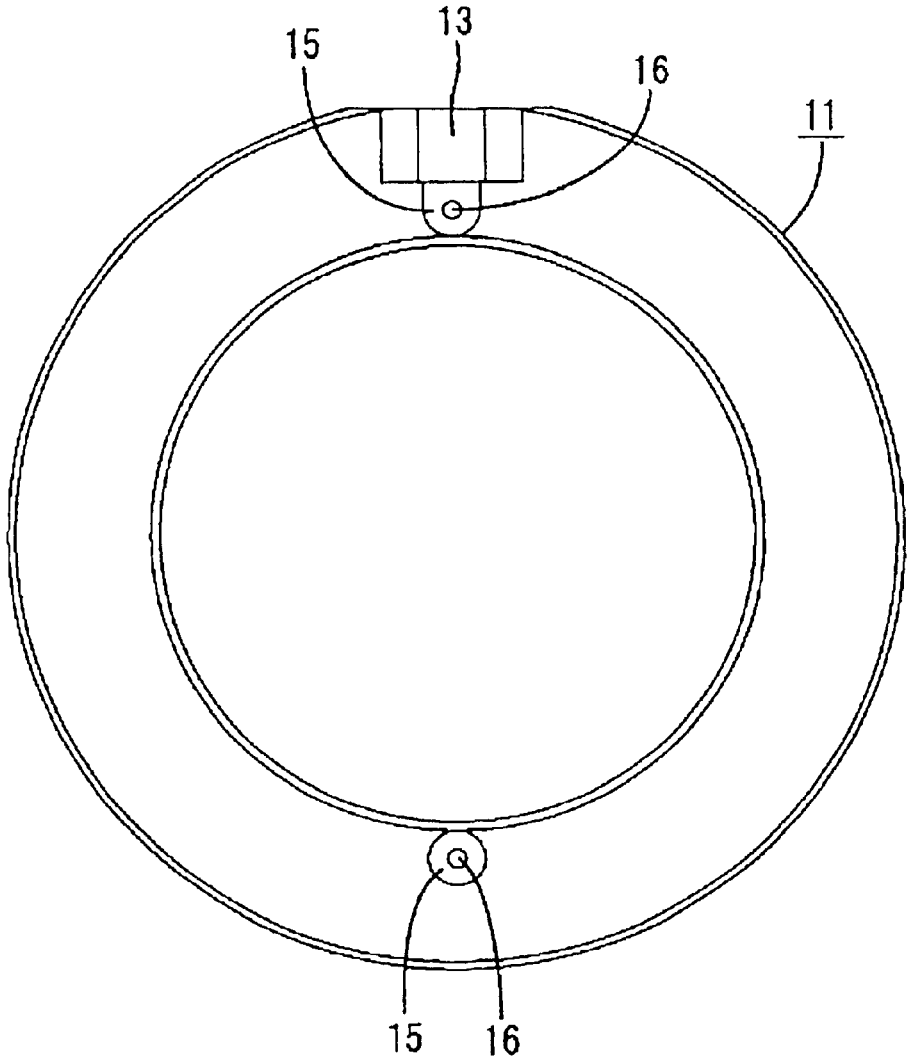
FIG. 1 is a rear view of a bobbin in a first embodiment of a coil apparatus in accordance with the present invention.
Figure 3:
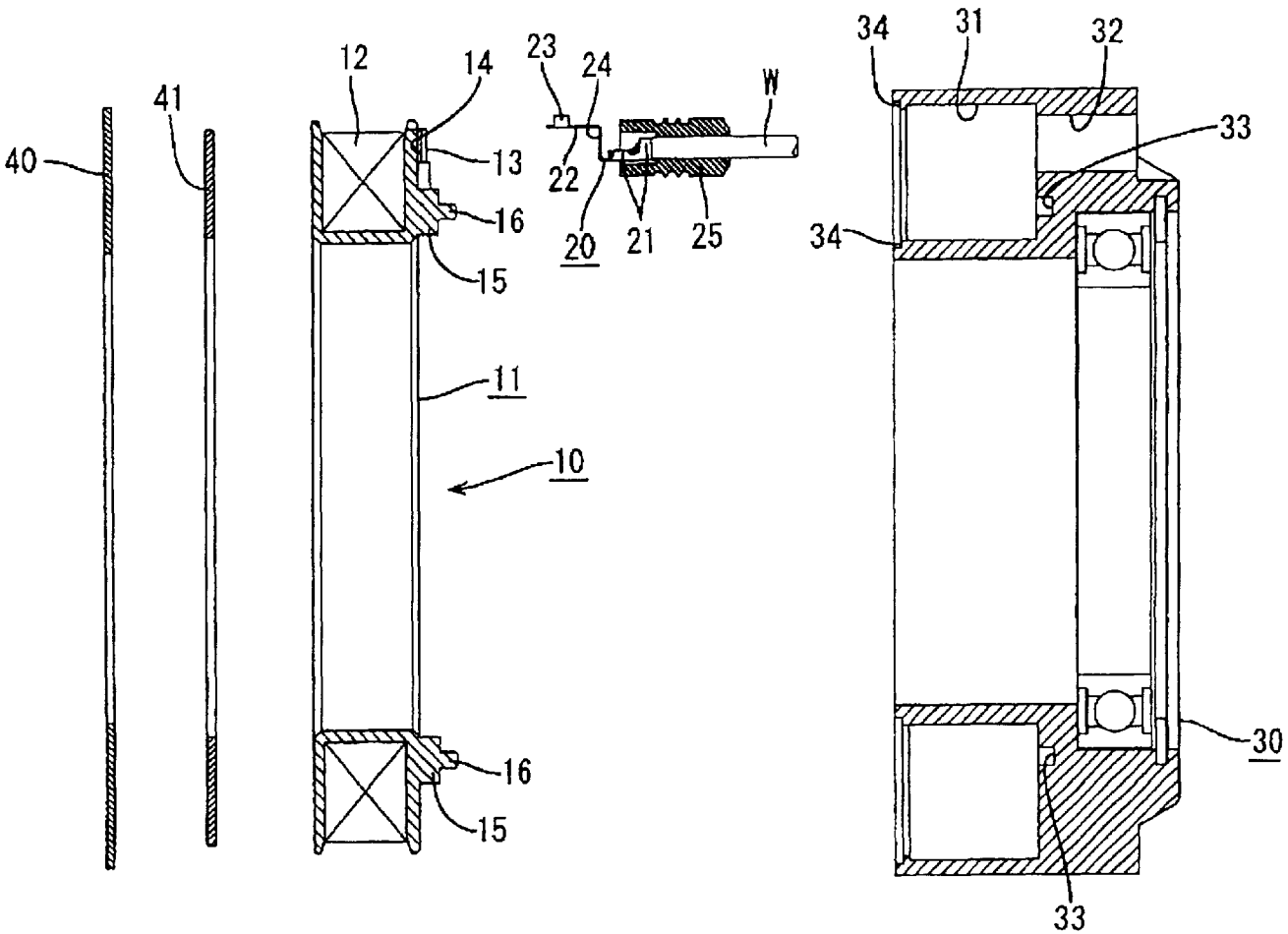
FIG. 3 is an exploded sectional view of a coil apparatus.

As shown in FIGS. 1 and 3, the coil 10 comprises a wiring 12 made of a copper wire bound around a synthetic resin bobbin 11 by a number of turns. The bobbin 11 is formed into an annular shape in plan view and includes a pair of flanges that extend outwardly from the opposite ends of a cylindrical portion around which the wiring 12 is bound. A terminal 20 is continuously connected to each of the opposite ends of the wiring 12. The terminal 20 is supported on a terminal-holding portion 13 on a rear surface (right side surface in FIG. 3) of the bobbin 11. The terminal-holding portion 13 is provided with a press-fitting slot 14 that can receive a press-fitting piece 24 of the terminal 20 by a press-fitting manner. A notch is formed in an outer peripheral edge of the flange opposed to the terminal-holding portion 13. The notch that permits the distal end of the terminal 20 to enter a space at the wiring side. Two abutments 15 are provided on the rear surface of the bobbin 11 (right side surface in FIG. 3). The abutments 15 are spaced angularly at about 180 degrees on the inner side from the terminal-holding portion 13 in the radial direction. An anti-rotation boss 16 is provided on the top surface of each abutment 15 at the center. The abutments 15 are adapted to contact an inner surface in the containing chamber 31 of the yoke 30 while the anti-rotation bosses 16 are adapted to fit anti-rotation recesses 33 in the yoke 30.

The terminal 20 is formed into a shape shown in FIG. 3 by stamping a metallic sheet into a given shape and bending the stamped metallic sheet. The terminal 20 includes a barrel 21 having a pair of crimping pieces adapted to be crimped onto an end of an electric wire W coupled to an external circuit. The terminal 20 also has a connection portion 22 that extends from the barrel portion 21 in a crank-shaped manner. The distal end of the connection portion 22 has a connecting piece 23 adapted to be connected to the winding 12 by caulking or welding. The connecting portion 22 is provided on the middle part with a press-entering piece 24. A substantially cylindrical rubber plug 25 is fit on the end of the electric wire W and has a length sufficient to cover the barrel 21 of the terminal 20. The rubber plug 25 has lips on inner and outer peripheral surfaces. The lips closely contact an outer peripheral surface of the electric wire W and an inner peripheral surface of a wire-drawing hole 32 in a yoke 30 described hereinafter, thereby giving a sealing function between the electric wire W and the wire drawing hole 32 (see FIG. 5).

Figure 2:
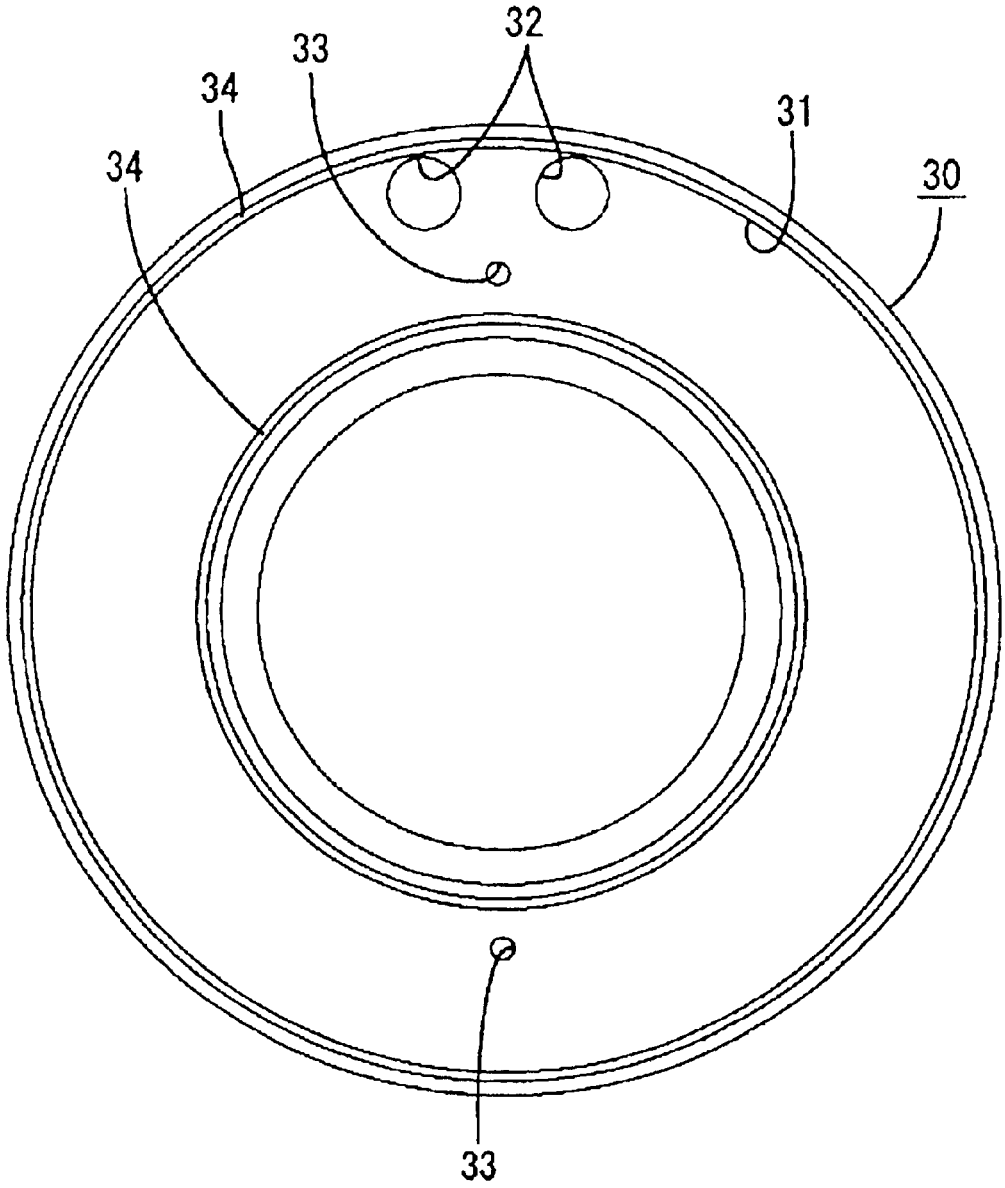
FIG. 2 is a front elevation view of a yoke.

The yoke 30 is formed into a substantially annular configuration shown in FIGS. 2 and 3 by pressing and then machining a metallic material. The yoke 30 is provided with a containing chamber 31 that defines a substantially annular groove with an opening at a front surface (left side surface in FIG. 3). A pair of wire-drawing holes 32 communicate to the containing chamber 31 and have openings at a rear surface (right side surface in FIG. 3). The coil 10 is inserted into the containing chamber 31 through a front side opening (left side opening in FIG. 3). The inner diameter of the containing chamber 31 is substantially the same as that of the coil 10. An inner wall of the containing chamber 31 is provided with two anti-rotation recesses 33 that are opposed to the anti-rotation bosses 16 of the coil 10. A bearing 34 is formed in each of inner and outer peripheral edges of the front opening in the containing chamber 31 to support the lid 40 mounted on the opening at the front side of the coil 10. The inner bearing 34 is formed on the whole open inner peripheral edge of the containing chamber 31 while the outer bearing 34 is formed on the whole open outer peripheral edge of the containing chamber 31. A raised portion is formed around the outer bearing portion 34. The electric wires W connected through the terminals 20 to the coil 10 are led out from the wire-drawing holes 32 while the rubber plugs 25 described above closely contact the inner surfaces of the wire-drawing holes 32.

The lid 40 is formed by cutting a metallic sheet into an annular plate, and is dimensioned to fit on the inner and outer bearings 34 of the containing chamber 31 with no play. Accordingly, when the lid 40 is mounted on the containing chamber 31, the inner and outer peripheral surfaces of the lid 40 engage the inner and outer bearings 34, so that the front surface (left side surface in FIG. 3) of the lid 40 coincides with the front surface (left side surface in FIG. 3) of the yoke 30 (see FIG. 6). The lid 40 is secured to the yoke 30 by welding. The secured lid 40 can cover the whole front surface (left side surface in FIG. 3) of the bobbin 11, thereby holding the coil 10 in the yoke 30 without exposing the coil 10 outwardly.

An annular rubber plate 41 is disposed between the bobbin 11 and the lid 40. The rubber plate 41 has a thickness in the natural state greater than a clearance between the bobbin 11 and the lid 40 regularly mounted on the yoke 30. Consequently, as the lid 40 reaches the bearings 34, the rubber plate is compressed elastically between the lid 40 and the bobbin 11 to cause an elastic reaction force against them during attachment of the lid to the yoke 30.

Figure 4:
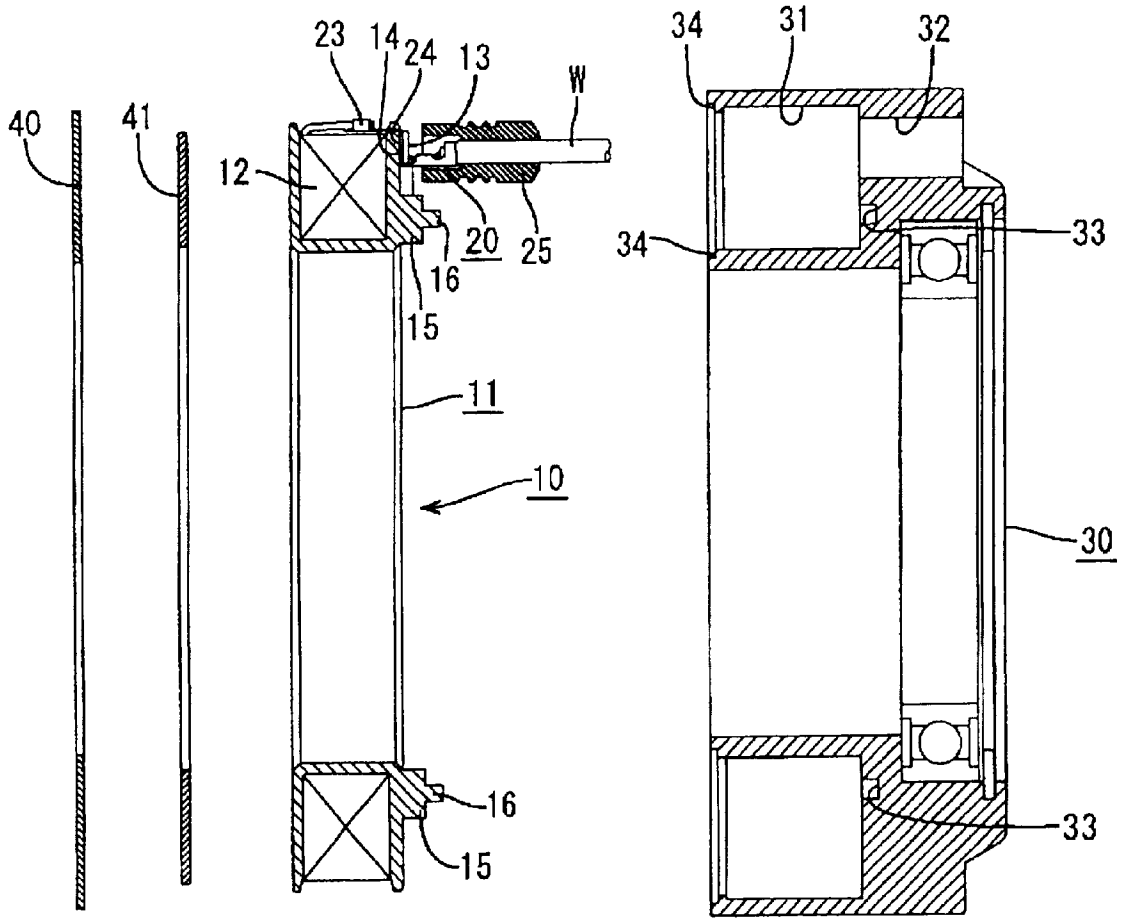
FIG. 4 is an exploded sectional view of a coil apparatus, illustrating a terminal attached to the bobbin.

Next, a process for assembling the coil apparatus of the present invention will be explained. As shown in FIG. 3, the winding 12 is bound around a cylindrical portion of the bobbin 11. The terminals 20 are crimped on the ends of the electric wires W after the rubber plugs 25 are mounted on the ends. As shown in FIG. 4, the terminals 20 are attached to the terminal-holding portions 13 of the bobbin 11. Opposite ends of the winding 12 drawn from the bobbin 11 are coupled to the connecting portions 22 of the terminals 20 by crimping or welding.

The coil 10 then is attached to the yoke 30. More particularly, the coil 10 is accommodated in the containing chamber 31 so that the rubber plugs 25 are inserted into the wire-drawing holes 32. The inner diameter of the coil 10 is substantially the same as that of the containing chamber 31, and hence they are fit easily at the coaxial position. The anti-rotation bosses enter the anti-rotation recesses 33 when the coil 10 is accommodated at the regular depth in the containing chamber 31, thereby preventing the coil 10 from rotating in the yoke 30 (see FIG. 5). At this time, the abutments 15 contact the inner surface of the containing chamber 31.

Figure 5:
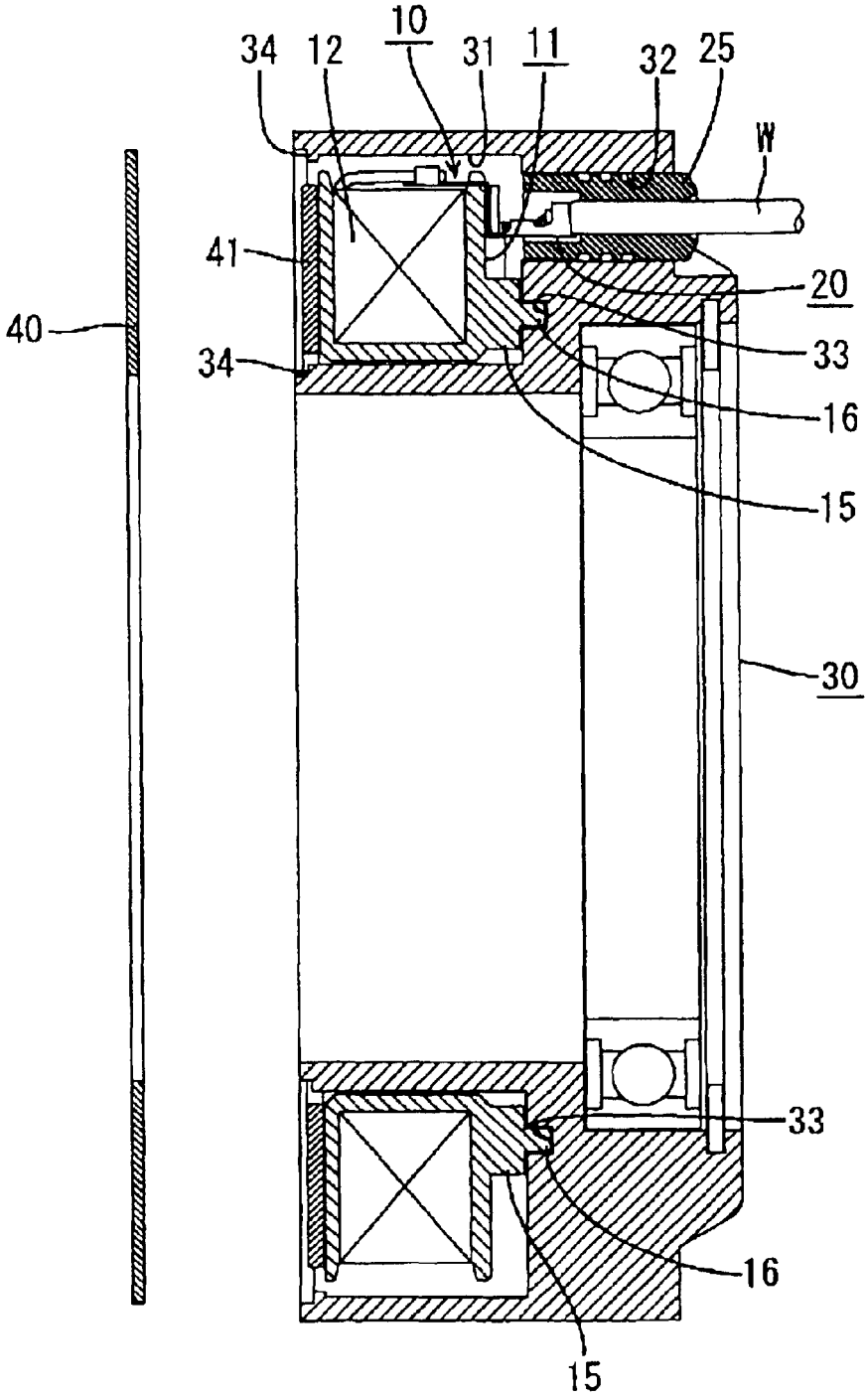
FIG. 5 is a sectional view of the coil apparatus, illustrating the apparatus containing a coil and a rubber plate in a containing cavity.
Figure 6:
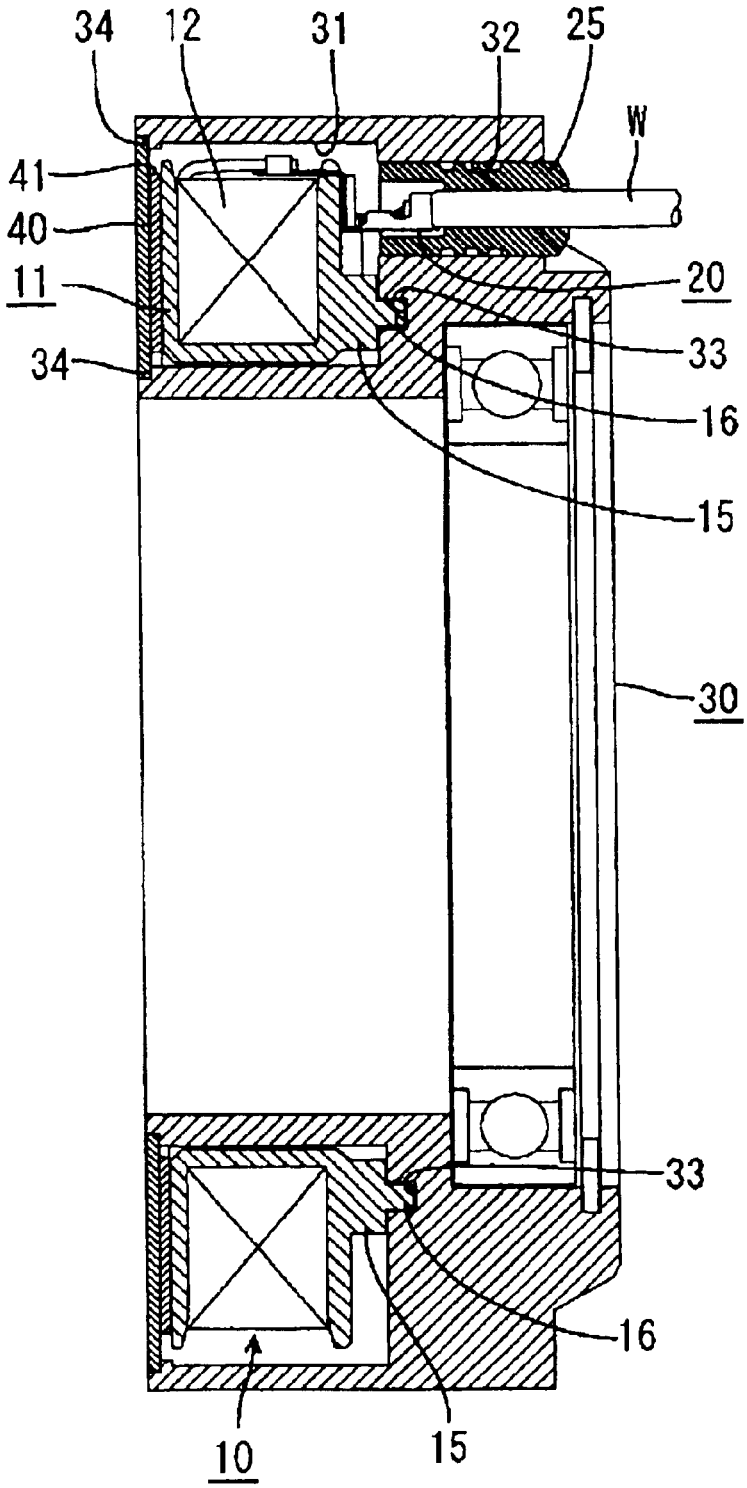
FIG. 6 is a sectional view of the coil apparatus, illustrating a lid body secured to the yoke.

Thereafter, as shown in FIG. 5, the rubber plate 41 is put on the left side surface of the bobbin 11 and the lid 40 is mounted on the opening of the containing chamber 31. The rubber plate 41 is comprised elastically between the lid 40 and the bobbin 11, while the lid 40 is being attached to the yoke 30. The lid 40 is urged into contact with the bearings 34 and then is secured to the yoke 30 by welding, as shown in FIG. 6. Under this condition, the rubber plate 41 is compressed elastically between the bobbin 11 and the lid 40 secured to the yoke 30 to cause an elastic reaction force. This elastic reaction force pushes the bobbin 11 against the inner surface of the containing chamber 31, thereby eliminating the play between the lid 40 and the yoke 30.

The yoke 30 and lid 40 cover the coil 10 without exposing the coil 10 outwardly. Thus, the winding 12 and bobbin 11 are not broken by interference with the other parts during transportation to a client. Also, since the coil 10 is held against the yoke 30 and lid 40 with no play by the rubber plate 41, it is possible to prevent the coil 10 from being broken and generating an abnormal noise due to a relative movement between the yoke 30 and the lid 40, even if the coil 10 is subject to vibration during transportation.

According to the embodiment described above, the lid 40 closes the containing chamber 31 in the yoke 30 after accommodating the coil 10 in the containing chamber 31. Thus, it is possible to hold the coil 10 by the yoke 30 and lid 40 without exposing the coil 10 outwardly, and the coil 10 can be protected at a low cost in comparison with the prior art coil apparatus in which the housing is formed around the coil by a molding method using an expensive mold die.

The rubber plate 41 is compressed elastically between the lid 40 and the bobbin 11. Therefore, the coil 10 can be held against the yoke 30 and lid 40 with no play.

Further, when the coil 10 is accommodated in the containing chamber 31, the anti-rotation bosses 16 on the coil 10 engage the anti-rotation recesses 33 in the yoke 30, thereby restricting a relative movement in the peripheral direction between the yoke 30 and the bobbin 11.

A second embodiment of the coil apparatus in accordance with the present invention will be described by referring to FIGS. 7 and 8. In the second embodiment, the lid and rubber plate in the first embodiment are omitted. A potting material 50 made of an epoxy resin or the like closes the containing chamber 31.

Figure 7:
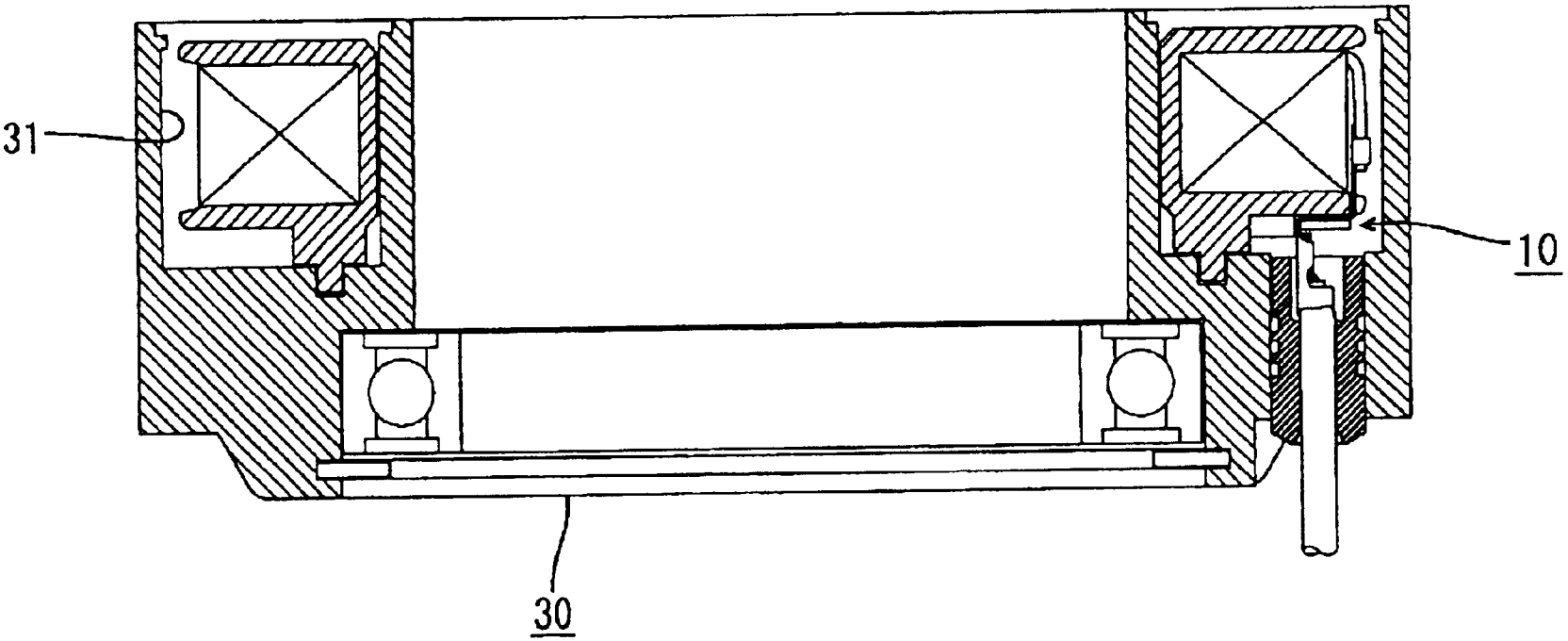
FIG. 7 is a sectional view of a second embodiment of the coil apparatus in accordance with the present invention, illustrating the yoke containing the coil.
Figure 8:
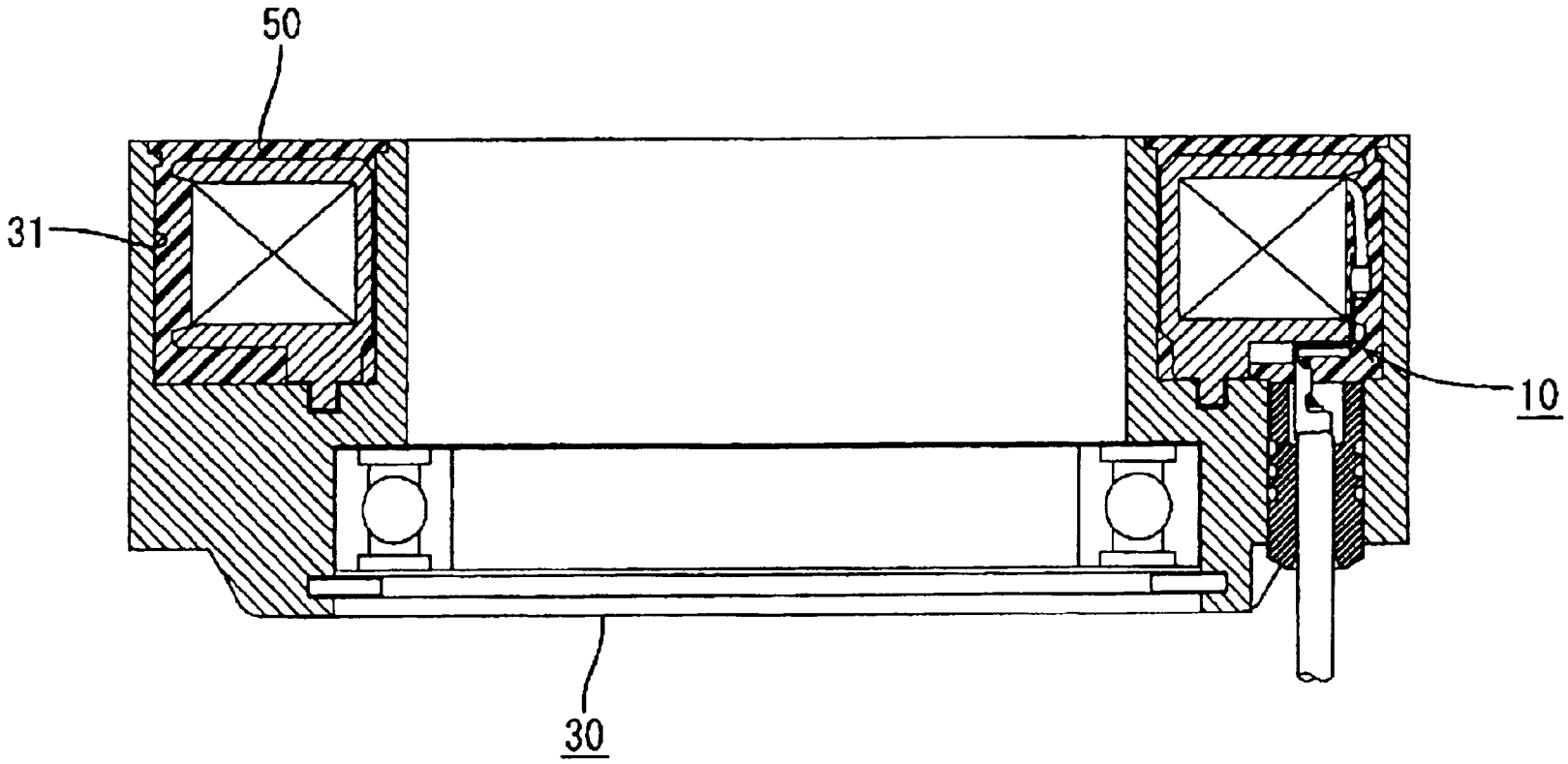
FIG. 8 is a sectional view of the coil apparatus shown in FIG. 7, illustrating the containing chamber in the yoke being filled with a potting material.

As shown in FIG. 7, the coil 10 is accommodated in the containing chamber 31 and the yoke 30 is postured at a horizontal position so that the opening of the containing chamber 31 is directed upward. A nozzle (not shown) connected to a dispenser (not shown) is inserted into the containing chamber 31 to inject the molten potting material 50 into the containing chamber 31. The potting material 50 fills the containing chamber 31 so that the top surface of the potting material 50 coincides with the top surface of the yoke 30. The nozzle then is drawn out from the containing chamber 31 and the molten potting material 50 is solidified. The coil 10, as shown in FIG. 8, is surrounded by a unitary matrix of the solidified potting material 50 and hence is secured in the yoke 30.

Thus, the potting material 50 closes the containing chamber 31 in the yoke 30 and the yoke 30 and potting material 50 protect the coil 10 without exposing the coil 10 outwardly. A potting apparatus is cheaper than the mold die used in the prior art molding method. Therefore, it is possible to lower a cost for equipment. In addition, the potting material 50 can easily seal the coil 10.

Since the other structure and operational effects in the second embodiment are the same as those of the first embodiment, an overlapping explanation of them will be omitted here.

A third embodiment of the coil apparatus in accordance with the present invention will be described by referring to FIGS. 9 to 13. The potting material 50 of the second embodiment gives a simple sealing to the containing chamber 31. However, the third embodiment is suitable for a requirement of a high sealing function. For example, the third embodiment is suitable for a coil apparatus to be immersed in oil.

Figure 9:
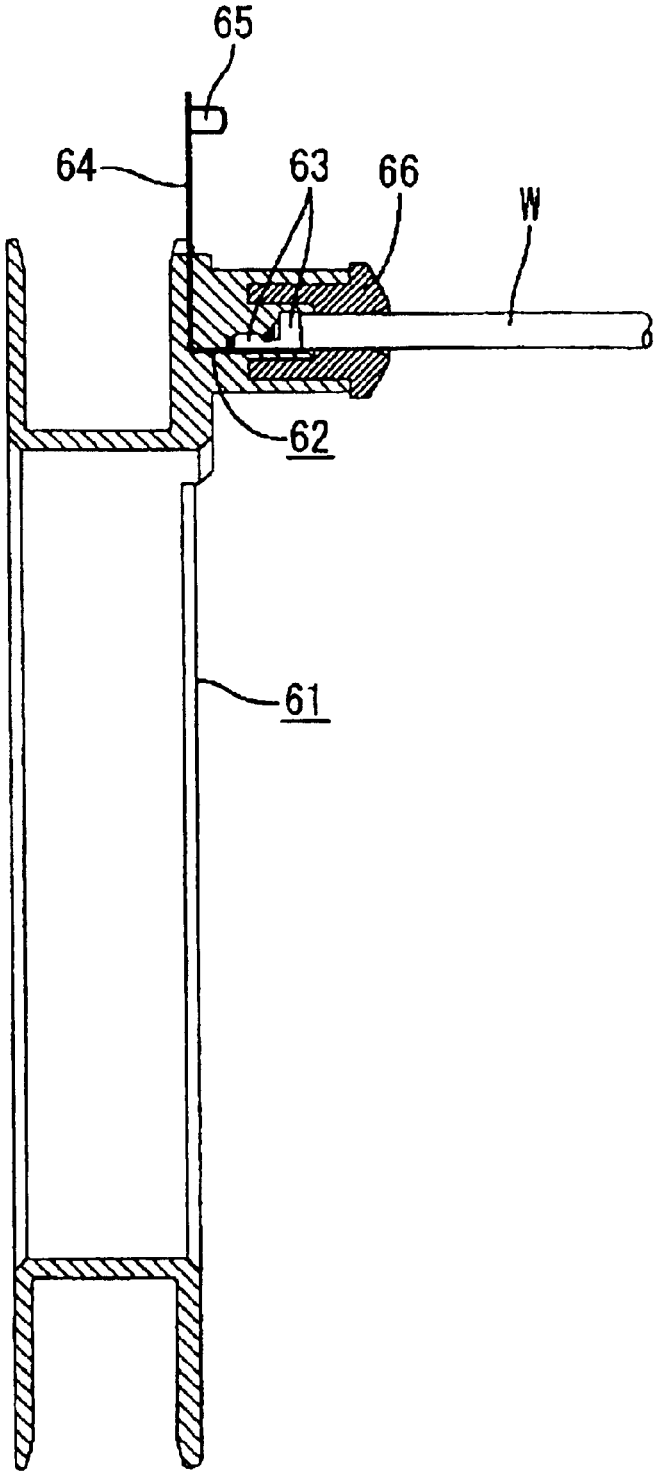
FIG. 9 is a sectional view of a bobbin in a third embodiment of the coil apparatus in accordance with the present invention, illustrating the bobbin prior to binding the wiring.
Figure 10:
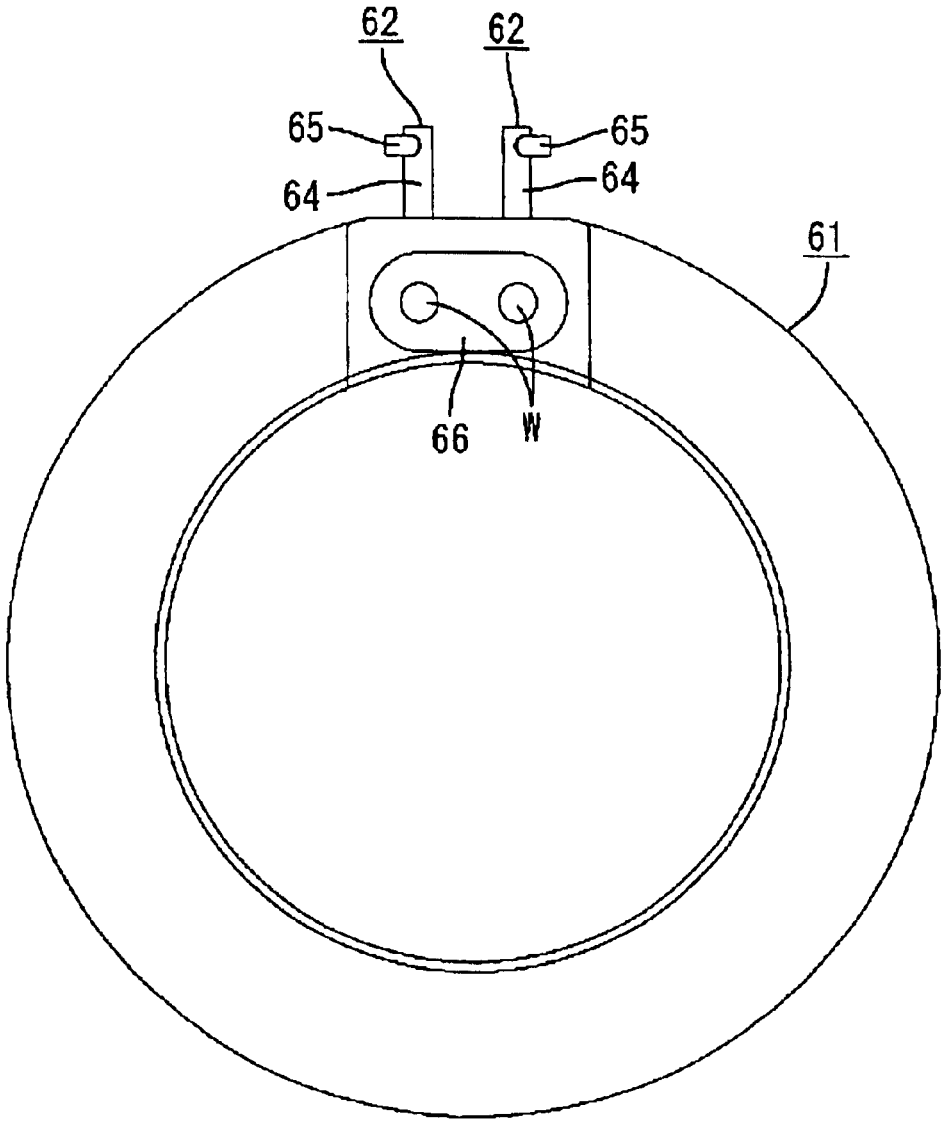
FIG. 10 is a rear view of the bobbin shown in FIG. 9.
Figure 11:
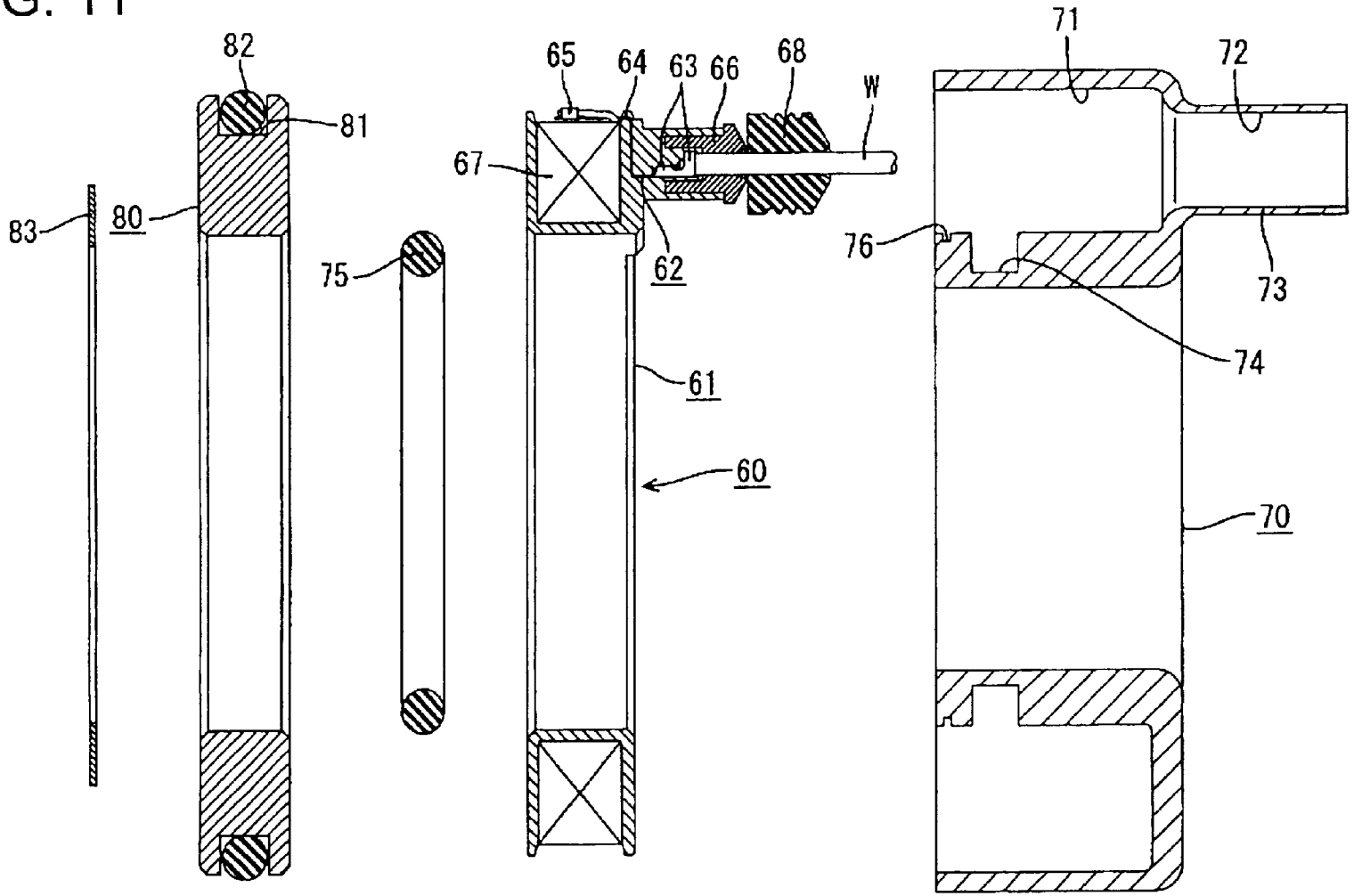
FIG. 11 is an exploded sectional view of the coil apparatus in the third embodiment.

As shown in FIG. 9, terminals 62 connected to the electric wires W are inserted into a bobbin 61 constituting a coil 60. In particular, barrels 63 of the terminals 62 are crimped on the ends of the electric wires W and a first rubber plug 66 is mounted on the ends of the electric wires W so that the plug 66 can protect the electric wires W during insert molding of the bobbin 61. The bobbin 61 is formed from a resin material that covers the outer peripheral surface of the first rubber plug 66. As shown in FIG. 10, the first rubber plug 66 can hold a bundle of two electric wires W passing through it. Connecting portions 64 of the terminals 62 initially extend straight along a radial direction from the insert molded bobbin 61. However, as shown in FIG. 11, a winding 67 is bound around the bobbin 61, and the connection portions 64 then are bent to the winding 67 and the opposite ends of a winding 67 are coupled to connecting pieces 65 of the connecting portions 64. A second rubber plug 68 is mounted on the electric wires W at the right side from the first rubber plug 66 in FIG. 13. The second rubber plug 68 is adapted to come into close contact with a wire-drawing hole 72 in the yoke 70.

The yoke 70 is provided with a substantially annular containing chamber 71 having an opening at the left side in FIG. 11. A wire-drawing portion 73 extends to the right side in FIG. 11 and has a wire-drawing hole 72 communicated to the containing chamber 71. The containing chamber 71 has a depth sufficient to accommodate the coil 60, a lid body 80 and a C-ring 83. The containing chamber 71 has an inner peripheral surface facing the lid body 80, and a seal ring attachment groove 74 is formed in this inner peripheral surface. An inner seal ring 75 is fit in the groove 74 so that the inner seal ring 75 closely contacts the inner peripheral surface of the lid body 80 accommodated in the containing chamber 71 after accommodating the coil 60 in the chamber 71. The inner peripheral surface of the containing chamber 71 also has a C-ring attachment groove 76 near the opening from the seal ring attachment groove 74. A C-ring 83 is fit in the groove 76 after accommodating the lid body 80 in the containing chamber 71 to prevent the coil 60 and lid body 80 from coming out from the yoke 70.

The lid 80 is formed into an annular shape and is slightly thinner than the bobbin 61. The inner and outer diameters of the lid 80 are substantially the same as those of the containing chamber 71. A sealing ring attachment groove 81 is formed in the outer peripheral surface of the lid 80. An outer seal ring 82 is fit in the seal ring attachment groove 81 to come into close contact with the outer peripheral surface of the containing chamber 71.

Figure 12:
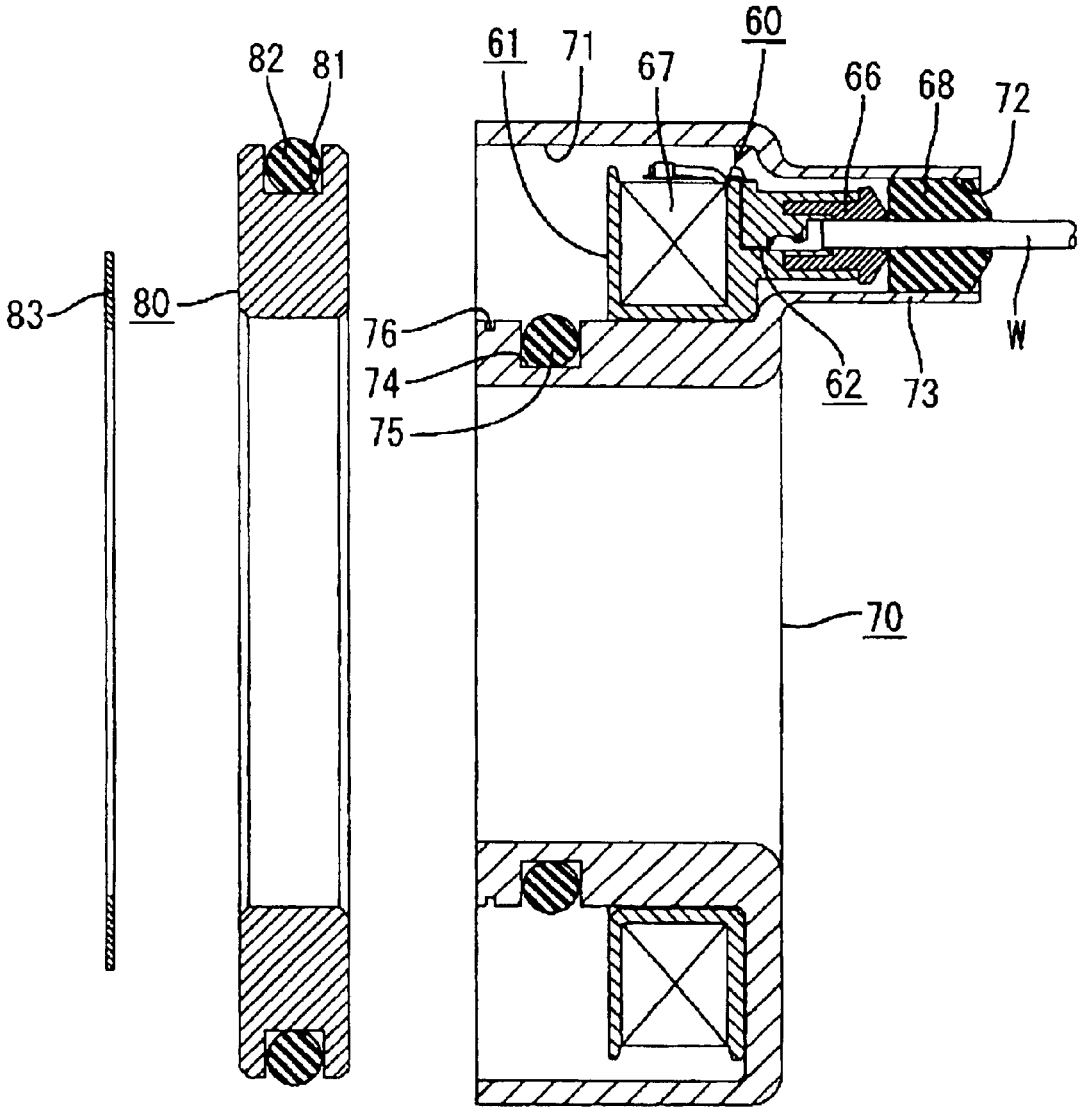
FIG. 12 is an exploded sectional view of the coil apparatus in the third embodiment, illustrating the containing chamber accommodating the coil and a seal ring.
Figure 13:
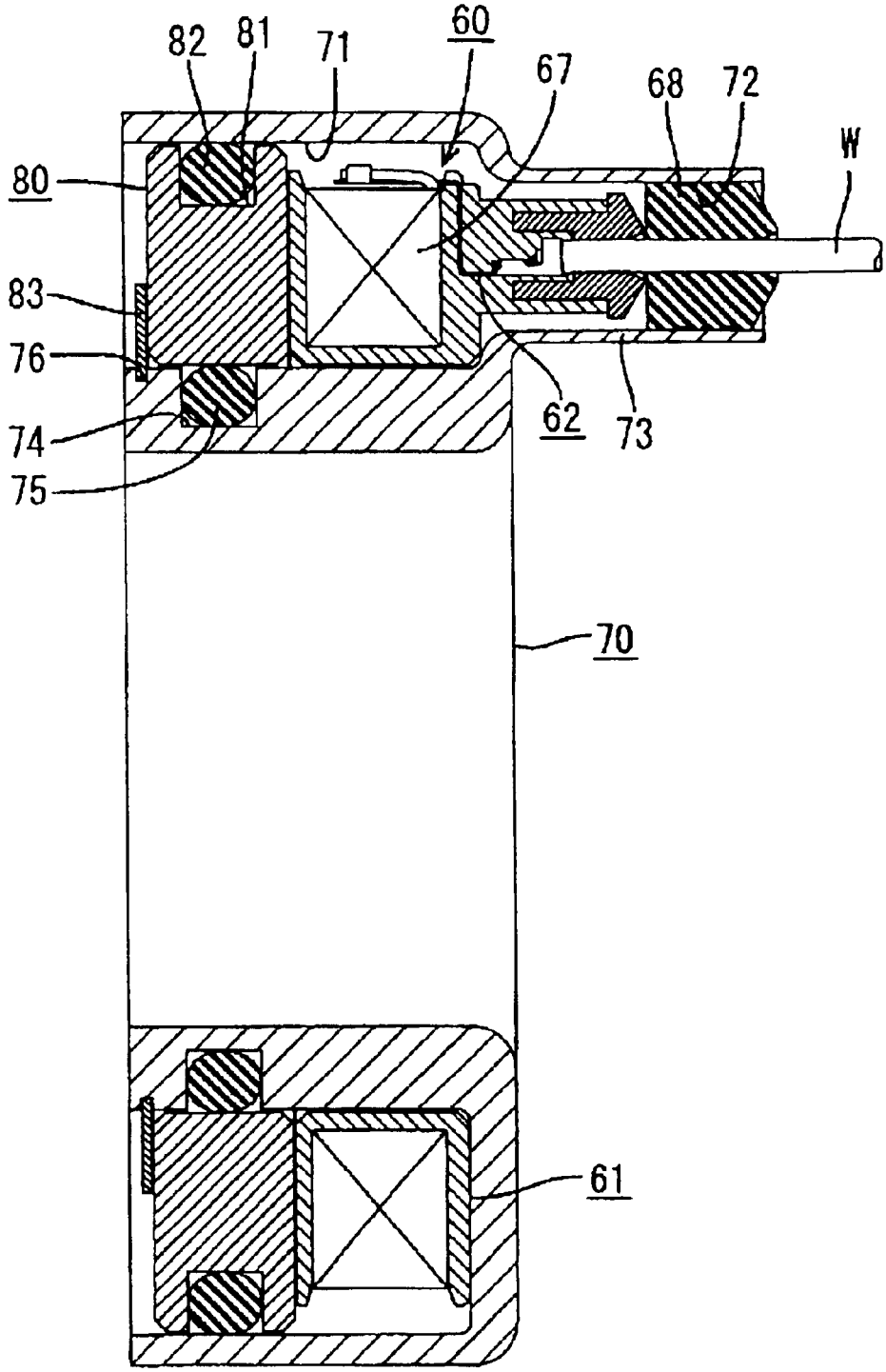
FIG. 13 is a sectional view of the coil apparatus in the third embodiment, illustrating the lid body and a C-ring being secured to the yoke.

When assembling the coil apparatus, as shown in FIG. 12, the coil 60 is accommodated in the containing chamber 71 so that the second rubber plug 68 is inserted into the wire drawing hole 72 to make a seal. After accommodating the coil 60 at the regular position, the inner seal ring 75 is fit in the seal ring attachment groove 74 in the yoke 70. The outer seal ring 82 then is fit in the seal ring attachment groove 81 of the lid 80, and the lid 80 is accommodated in the containing chamber 71. The outer seal ring 82 closely contacts the outer peripheral surface of the containing chamber 71 as the lid 80 is accommodated in the containing chamber 71, while the inner seal ring 75 closely contacts the inner peripheral surface of the chamber. The lid 80 is inserted into the containing chamber 71 until the right side surface of the lid 80 in the drawing contacts the left side surface of the bobbin 61 in the drawing. Thus, both seal rings 75 and 82 are disposed in substantially the same position in the depth direction of the containing chamber 71 (see FIG. 13). The C-ring 83 then is fit in the C-ring attachment groove 76 in the yoke 70, so that the lid 80 and coil 60 are held so as not to come out the yoke 70, as shown in FIG. 13.

Under this condition, the second rubber plug 68 seals clearances between the electric wires W and the wire-drawing hole, while the inner seal ring 75 and outer seal ring 82 seal a clearance between the lid 80 and the yoke 70, thereby positively preventing a liquid, such as oil or the like, from entering the containing chamber 71 from the outside. Consequently, the third embodiment can provide a coil apparatus having a higher sealing performance.

Since the other structure and operational effects in the third embodiment are the same as those of the first embodiment, an overlapping explanation of them will be omitted here.

It should be noted that the present invention is not limited to the embodiments described above and illustrated in the drawings. For example, the present invention includes the following embodiments. Further, the present invention can be embodied within the scope that does not deviate from the gist of the invention except for the following embodiments.

Although the lid is secured to the yoke by welding in the first embodiment, a mechanical fixing means, such as a C-ring, may be used. Similarly, the lid may be secured to the yoke by a means other than the C-ring in the third embodiment.

The number and shape of the anti-rotation boss and recess may be altered in the first and second embodiments. Also, the anti-rotation boss and recess may be applied to the coil apparatus in the third embodiment.

Although the rubber plate is used as an elastic means in the first embodiment, a compression coil spring may be used. Also, the rubber plate may be adhered to the lid or the yoke as an integrated part. The elastic means may be applied to the coil apparatus in the third embodiment.

Although the respective seal ring attachment grooves are provided in the respective lid and yoke in the third embodiment, two seal ring attachment grooves may be provided in either the lid or the yoke.

Although the lid is fit in the containing chamber in the respective embodiments described above, the lid may be secured to the outside of the yoke.

What is claimed is:

1. A coil apparatus comprising:

a coil formed by binding a wiring around a bobbin; and a holding member having a substantially annular containing chamber adapted to accommodate said coil;

said holding member including a closing element for closing said containing chamber to cover said coil, said closing element including a lid mounted on said containing chamber and secured to said holding member, an elastic element disposed between said lid and said bobbin so that said elastic element is elastically compressed when said lid is mounted on said containing chamber.

2. The coil apparatus of claim 1, wherein said closing element includes a potting material filled into and solidified in said containing chamber.

3. A coil apparatus comprising:

a coil formed by binding a wiring around a bobbin;

a holding member having a substantially annular containing chamber adapted to accommodate said coil, said holding member including a closing element for closing said containing chamber to cover said coil, said closing element including a lid mounted on said containing chamber and secured to said holding member; and a pair of seal rings disposed between opposed peripheral surfaces of said lid and containing said chamber so that said containing chamber is sealed when said seal rings come into close contact with the opposed peripheral surfaces.

4. The coil apparatus of claim 3, wherein an elastic element is disposed between said lid and said bobbin so that said elastic element is elastically compressed when said lid is mounted on said containing chamber.

5. The coil apparatus of claim 3, wherein anti-rotation means are provided between said bobbin and said holding member to maintain said bobbin at an anti-rotation position relative to said holding member when said means are coupled to each other.

6. A coil apparatus comprising a coil formed by binding a wire around a bobbin;

a holding member having a substantially annular containing chamber adapted to accommodate said coil, said holding member including a closing element for closing said containing chamber to cover said coil; and anti-rotation means are provided between said bobbin and said holding member to maintain said bobbin at an anti-rotation position relative to said holding member when said means are coupled to each other.

7. The coil apparatus of claim 6, wherein said closing element includes a lid mounted on said containing chamber and secured to said holding member.

8. A coil apparatus comprising:

a bobbin having a tubular inner wall and first and second substantially parallel end walls extending outwardly from the inner wall to define an open space outwardly from the tubular inner wall and between the first and second end walls;

a coil formed by binding a wire in the space around the tubular inner wall of the bobbin and between the first and second end walls;

a yoke having a first end wall and inner and outer tubular walls projecting from the first end wall for defining a chamber with an annular opening, the bobbin and the coil thereon being disposed in the chamber of the yoke between the inner and outer tubular walls of the yoke; and a closing lid mounted to the inner and outer tubular walls of the yoke for closing the chamber and covering the bobbin and coil therein.

9. The coil apparatus of claim 8, wherein an elastic element is disposed between said lid and said bobbin so that said elastic element is elastically compressed when said lid is mounted over said chamber.

10. The coil apparatus of claim 8, wherein a pair of seal rings are disposed between opposed peripheral surfaces of said lid and said chamber so that said containing chamber is sealed when said seal rings come into close contact with the tubular walls of the yoke.

11. The coil apparatus of claim 8, wherein said closing element includes a potting material filled into and solidified in said chamber.

12. The coil apparatus of claim 8, wherein anti-rotation means are provided between said bobbin and said yoke for to maintaining said bobbin at an anti-rotation position relative to said yoke.

* * * * *